US005921044A

United States Patent [19]

Holztrager

[11] Patent Number: 5,921,044

[45] Date of Patent: Jul. 13, 1999

[54] DISPLAY WALL ASSEMBLY AND METHOD OF MAKING SAME

[76] Inventor: William J. Holztrager, P.O. Box AJ, Chilhowie, Va. 24319

[21] Appl. No.: 08/820,689

[22] Filed: Mar. 18, 1997

[51] Int. Cl.[6] ..... E04B 2/88; A47B 96/06

[52] U.S. Cl. ..... 52/483.1; 52/235; 52/506.05; 52/506.08; 52/506.01; 211/41.1; 211/41.12; 248/220.21; 108/108

[58] Field of Search ..... 52/235, 483.1, 52/506.05, 506.08, 506.01, 508, 509; 211/41.1, 41.12, 94.01, 94.03, 40, 87.01, 88.01; 248/220.21, 222.2, 220.31; 108/108, 152

[56] References Cited

U.S. PATENT DOCUMENTS

| | | | |
|---|---|---|---|
| 394,144 | 12/1888 | Sword . | |
| 2,824,630 | 2/1958 | Tolman . | |
| 3,252,259 | 5/1966 | Gerhardt . | |
| 4,495,741 | 1/1985 | Pasiecznik | 52/508 X |
| 4,629,076 | 12/1986 | Amstutz et al. . | |
| 4,694,965 | 9/1987 | Parnell | 211/87.01 |
| 4,752,010 | 6/1988 | Holztrager . | |
| 4,785,946 | 11/1988 | Sorensen . | |
| 4,825,601 | 5/1989 | Halverson . | |
| 4,931,340 | 6/1990 | Baba et al. | 108/51.11 X |
| 4,944,416 | 7/1990 | Petersen et al. . | |
| 5,101,986 | 4/1992 | Holztrager . | |
| 5,148,925 | 9/1992 | Althoff et al. . | |
| 5,224,610 | 7/1993 | Veazey . | |
| 5,241,796 | 9/1993 | Hellwig et al. . | |
| 5,383,317 | 1/1995 | Menchetti | 52/509 X |
| 5,390,462 | 2/1995 | Kreiter . | |
| 5,394,666 | 3/1995 | Zahner, III | 52/506.05 X |
| 5,417,020 | 5/1995 | Dobija | 52/508 X |
| 5,484,067 | 1/1996 | Sothman | 211/87.01 |
| 5,485,934 | 1/1996 | Holztrager . | |
| 5,709,058 | 1/1998 | Shaw | 52/508 X |

*Primary Examiner*—Carl D. Friedman
*Assistant Examiner*—Brian E. Glessner
*Attorney, Agent, or Firm*—Shlesinger, Arkwright & Garvey LLP

[57] ABSTRACT

A display wall assembly for displaying items, comprises a support; first and second profile units being adapted to enable displaying of the items, the profile units being attached to the support in a spaced relationship; a panel supported by and disposed between the profile units; and, a light-weight intermediate reinforcing structure interposed between the panel, the support and the profile units.

20 Claims, 4 Drawing Sheets

DISPLAY WALL ASSEMBLY AND METHOD OF MAKING SAME

FIELD OF THE INVENTION

This invention relates generally to display or exhibit wall assemblies for use in displaying items or merchandise.

BACKGROUND OF THE INVENTION

Over the years, it has been standard practice to display merchandise or items by the means of a so-called slatwall or slotwall panels. The slatwalls are generally comprised of profile units which are spaced in a parallel relationship and form horizontal grooves between the adjacent profiles. These horizontal grooves are adapted to receive slotwall hardware, or some other supporting means, to which merchandise is either placed on or hung from, for display.

A problem with this conventional type slatwall is the undesirable appearance of continuous grooves spanning the entire display. Merchants generally only utilize several of the grooves to display their merchandise. Thus, the remaining grooves are left visible to consumers. These visible grooves are unattractive. Accordingly, there has been numerous attempts to provide either a cover for the unused grooves or a blank face structure to occupy the space between the used grooves. Examples are disclosed in U.S. Pat. No. 4,825,601, issued May 2, 1989; U.S. Pat. No. 4,785,946, issued Nov. 22, 1988; U.S. Pat. No. 5,390,462, issued Feb. 21, 1995; U.S. Pat. No. 5,241,796, issued Sep. 7, 1993; U.S. Pat. No. 5,224,610, issued Jul. 6, 1993. However, these attempts have failed to provide a cover or a blank face that is reinforced to prevent the face from breaking upon the application of a force pushing against the face.

Additionally, it is desired to have a display wall which is light-weight, to reduce the support necessary to hold the wall and to reduce costs. Examples of attempts to reduce the weight of panel type structures, namely doors, can be seen in U.S. Pat. No. 3,252,259, issued May 24, 1966 and U.S. Pat. No. 2,824,630, issued Feb. 25, 1958.

Other slatwall displays as well as other display systems can been seen in U.S. Pat. No. 4,944,416, issued Jul. 31, 1990; U.S. Pat. No. 4,629,076, issued Dec. 16, 1986; U.S. Pat. No. 5,148,925, issued Sep. 22, 1992; and, U.S. Pat. No. 394,144, issued Dec. 4, 1888.

All of these numerous attempts have failed to provide a lightweight display wall with a reinforced face panel to obviate unused grooves, which is also inexpensive to manufacture, appealing to the eye of the consumer and which allows flexibility of groove arrangement for the merchant.

OBJECTS AND SUMMARY OF THE INVENTION

It is an object of the present invention to provide a display wall that is about 40 percent to 50 percent reduced in weight from the conventional slatwall.

Yet another object of this invention is to provide a reinforced face panel to occupy the space where the conventionally unused grooves would be positioned.

Still a further object of this invention is to provide a display wall assembly having a reinforcement for a face panel such that the face panel will not collapse.

A further object of this invention is to provide a display wall assembly, which allows a face panel to be arranged so that it remains substantially flush with the profile units which support it.

Yet another object of this invention is to provide a display wall assembly, which is appealing to the eye of the consumer.

Still a further object of this invention is to provide a display wall assembly, which allows the merchant to be flexible in the design and arrangement of the grooves of the display wall.

Yet another object of this invention is to provide a display wall assembly, in which the reinforced face panel does not need to be planar or rectangular in shape.

A further object of this invention is to provide a display wall assembly, which is inexpensive to manufacture.

In summary, the present invention discloses a novel configuration for a display wall assembly, which includes a support, at least 2 profile units being attached to the support in a spaced relationship, a panel being supported by and disposed between the profile units and an intermediate reinforcing structure being interposed between the panel, the support and the profile units, for aiding the panel from collapsing toward the support.

The present invention further discloses the novel configuration of the display wall assembly previously mentioned where the panel is substantially flush with the outer face surface of the profile units.

Additionally, the present invention also discloses a method of manufacturing the afore-mentioned display wall, namely, providing a support, supplying at least two profile units, arranging the profile units in a spaced relationship, attaching the profile units to the supports supplying and positioning a panel between the profile units, for supporting the panel, providing a light-weight intermediate reinforcing structure, and interposing the intermediate reinforcing structure between the panel, the support and the profile units, for aiding the panel from collapsing toward the support.

These and other objects of the invention will be apparent from the following detailed description.

DETAILED DESCRIPTION OF THE INVENTION

Figure 1:
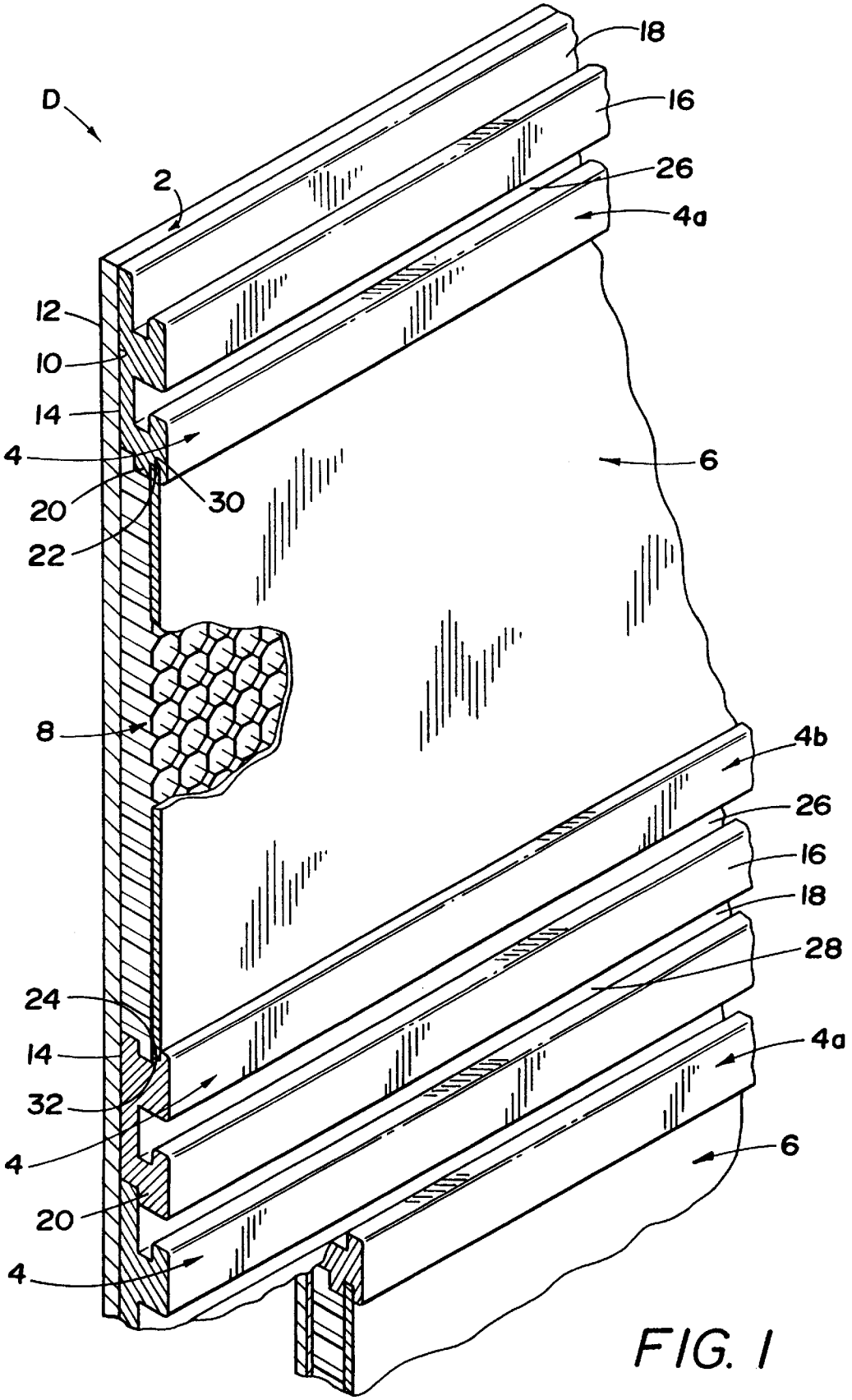
FIG. 1 is a fragmentary left front isometric view of a display wall assembly in accordance with the present invention.
Figure 2:
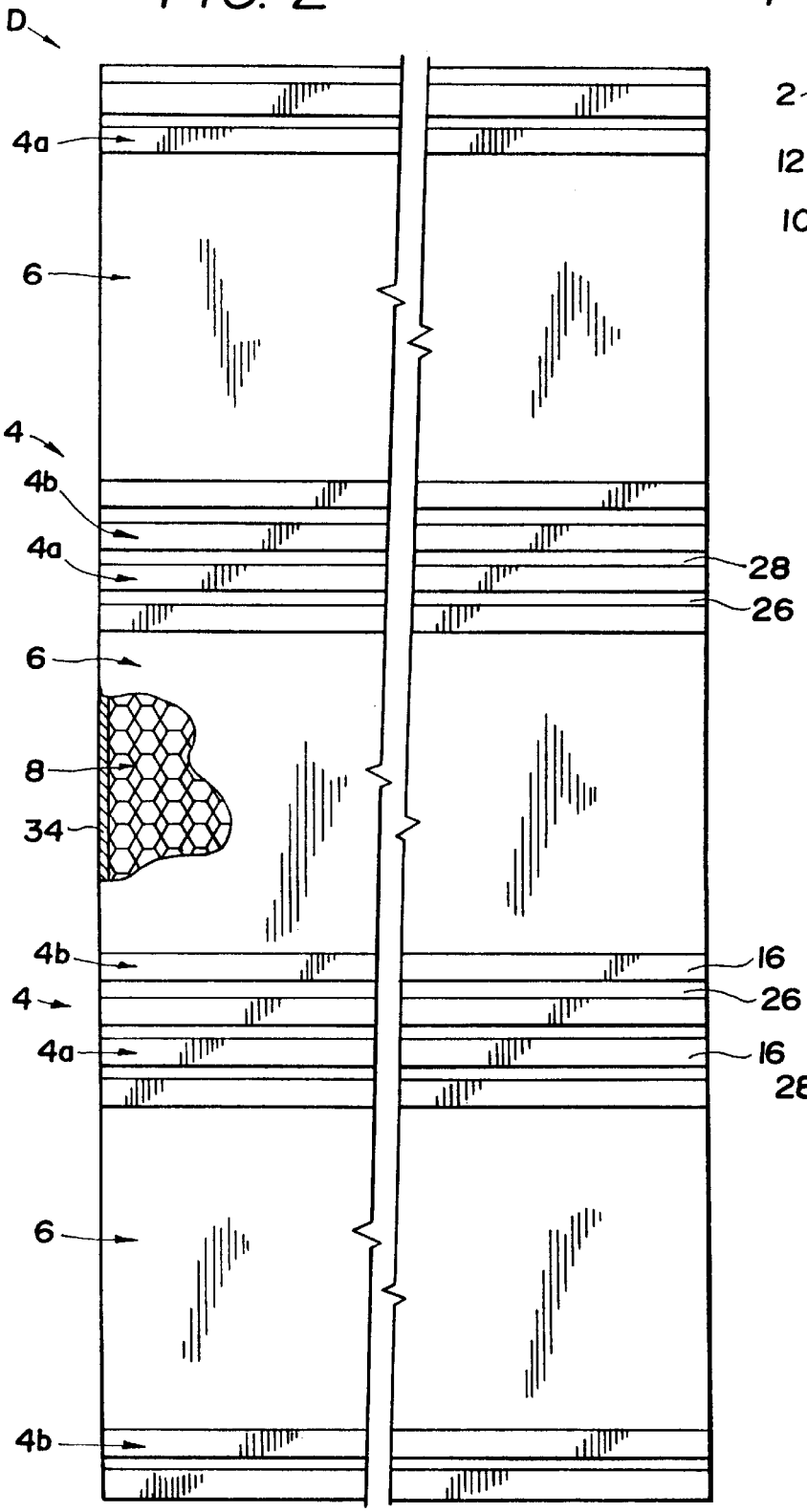
FIG. 2 is a fragmentary front elevational view of the display wall assembly of FIG. 1.
Figure 3:
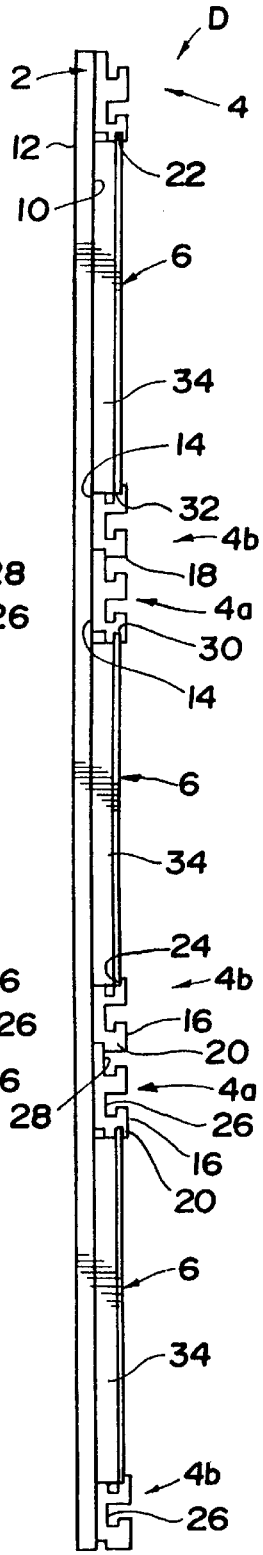
FIG. 3 is a side elevational view of the display wall assembly of FIG. 2.

FIGS. 1, 2 and 3

Referring to FIGS. 1, 2 and 3, a display wall assembly D made in accordance with the present invention is shown comprised of a support or backboard 2, a plurality of profile units 4, a face panel 6 and an intermediate reinforcing structure, or spacer 8.

The support 2 may be made of acrylic, fiber board, particle board, plywood, metal or wood. The support 2 includes an attachment surface 10 and a wall surface 12. The attachment surface 10 is the side of the support 2 to which other elements of this invention will be attached, as will be discussed further below. The wall surface 12 is the side of the support 2 to which the display wall assembly D will be connected to a wall, not shown, or some other supporting device.

Note, the backboard or support 2 does not have to have the planar shape as shown in FIGS. 1, 2 and 3. The support 2 could be of any structure, such as plurality of backing strips arranged in a single direction or multiple directions, as disclosed in applicant's copending patent application Ser. No. 08/743,624 for a Merchandise Display Panel.

The profile units 4 are adapted to enable the displaying of items. Each profile unit 4 is preferably of a unitary extruded construction such as polyvinyl-chloride, Class A fire rating. However, it is understood that the profile units 4 can be made of fiber board, metal, particle board, wood or the like. Examples of profile units are described in U.S. Pat. Nos. 5,485,934 and 4,752,010.

The profile units 4 have a back surface 14 for attaching to the support 2. The profile units 4 can be glued or screwed to the support 2 or both. For gluing, a common contact cement may be used. For deep dimension profile units, such as 4*c* and 4*d* shown in FIG. 4, the profile units 4*c*–4*d* will be engaged in a routed channel of the support 2, as will be discussed below. Note, the material properties of the profile units 4 apply to all of the profile units shown in FIGS. 1–5, namely 4*a*–4*f*.

The profile units 4 include an outer surface 16 which may be finished in any suitable color. The profile units 4 also include an upstanding flat portion 18 and a lower portion 20.

Shown in FIGS. 1–3 are profile units 4*a* and 4*b*. These profile units 4*a* and 4*b* are simply modified profile units.

Profile unit 4*a* includes a first channel 22, which is substantially coextensive with the length of the profile unit 4*a*. The first channel 22 is made by making or routing a channel, which is substantially parallel to the outer face 16, in the lower portion 20.

Profile unit 4*b*, includes a second channel or a flange 24, which is substantially coextensive with the length of the profile 4*b*. The second channel or flange 24 is made by slicing off, routing-out or removing the upstanding flat portion 18 off a normal profile unit 4, so that the flange 24 remains as the utmost portion of the profile unit 4*b*.

The first channel 22 and the second channel or flange 24 are for the engagement and support of the face panel 6. In other words, the face panel 6 will rest behind the flange 24 and engage the first channel 22, as shown in FIGS. 1–3 and as will be discussed further below.

The profile units 4*a* and 4*b* include an integral longitudinal groove 26 for the attachment of conventional slatwall or slotwall hardware for displaying items or merchandise.

When any two profile units 4 are aligned parallel to each other as well as stacked vertically next to each other, a groove 28 is formed, also for allowing the attachment of conventional slotwall hardware for displaying items.

The profile units 4 are preferred to be arranged in a parallel relationship.

It is further preferred that the profile units 4 be arranged in a substantially horizontal manner.

The face panel 6 may be constructed of polyvinyl chloride, fiber board, metal, particle board, wood, or the like. In FIGS. 1–3, the panels 6 are illustrated as polyvinyl chloride. The panels 6 are supported by and disposed between the profile units 4. The panels 6 are attached, laminated or glued to the intermediate reinforcing structure 8. The panels 6 are preferred to be generally planar in shape.

Each panel 6 includes a top edge 30 and a bottom edge 32. To support the panel 6, the top edge 30 is engaged and coextensive with the first channel 22 of the profile unit 4*a* and the bottom edge 32 is engaged or set behind and coextensive with the second channel or flange 24 of the profile unit 4*b*. With this arrangement, shown in FIGS. 1–3, the face panel 6 will be supported by the profiles.

The panels 6 advantageously eliminate the non-attractive, unused grooves. With the conventional display walls, the undesirable grooves would be visible to the consumers. According to the present invention, the face panel 6 will now be the portion of the display wall that is visible to the consumer. The face panel 6 can even be decorated with fabric, laminates, mirrors or mirror plexie, multi-color finishes, low gloss chemical coatings, such as those provided by Sherman Williams Polane, vinyl coverings, cork or wood grains. With these types of decorations, merchants can obtain the decor and the atmosphere that they desire.

It is preferred that each panel 6 be supported by the profile unit 4, such that the panels 6 are substantially flush with the outer face surfaces 16 of the profile units 4.

It is noted, for fire safety, the panel 6 and the profile 4 can be of a Class A fire rated surface.

The intermediate reinforcing structure or spacer 8 is to be of a light-weight design. The intermediate reinforcing structure 8 should be interposed between the panel 6, the support 2 and the profile units 4. The intermediate reinforcing structure 8 will aid or help prevent the panel 6 from collapsing toward the support 2. Without the intermediate reinforcing structure 8, the panel 6 would tend to bow, bend or even break with the application of forces upon its surface, especially forces that are normal or perpendicular to its surface.

It is important for the intermediate reinforcing structure 8 to be of a light-weight design. With a light-weight design, the display wall assembly D will be reduced in weight considerably. Conventional display wall assemblies would normally have profile units occupying the entire space that the panel 6 and that the intermediate reinforcing structure 8 occupy. As such, the weight of the conventional display wall assembly is much heavier, than the present invention.

The intermediate reinforcing structure 8 is advantageously preferred to be made from a cardboard honey comb material. However, it is understood that the intermediate reinforcing structure 8 could be of any light-weight material, such as, styrofoam, plastic, cork or the like, so long as it provides enough support to help prevent the panel 6 from collapsing toward the support 2.

The intermediate reinforcing structure or light-weight spacer 8 is preferred to be attached, glued or laminated, to the support 2.

Also forming a part of the display wall assembly D is a side panel 34, as shown in FIGS. 2 and 3. The side panel 34 is for aesthetic purposes in that it covers exposed portions of the intermediate reinforcing structure 8. In other words, it covers the visible honey comb structure that remains at the ends of the display wall assembly D.

FIG. 4

Figure 4:
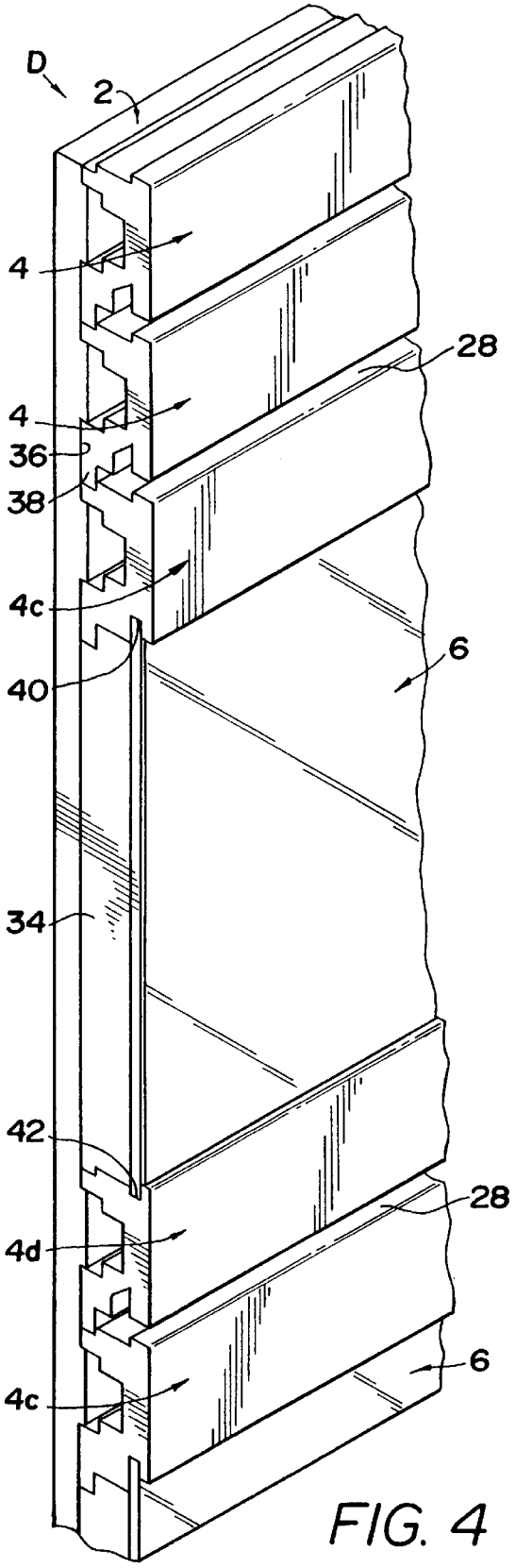
FIG. 4 is a fragmentary left front isometric view of an alternative embodiment of the display wall assembly made in accordance with the present invention.

Referring to FIG. 4, a display wall assembly D is shown having a form of profile units, namely deep dimension profile units 4*c* and 4*d*. These deep dimension profile units 4*c*–4*d*, are simply different types of profile units 4. The differences between profile units 4*c*–4*d* and 4*a*–4*b* are the number of grooves in the profiles, their size and how they attach to the support 2. The profile units 4*c*–4*d* are described in greater detail in U.S. Pat. No. 4,752,010.

The deep dimension profile units 4*c*–4*d*, are secured to the support 2 by engaging channels 36, which are routed or carved-out of the support 2. The channels 36 are carved-out to match the particular attachment portion 38 of the particular profile units 4*c*–4*d*. In other words, the profile units 4*c*–4*d* are secured to the support 2 by having their attachment portions 38 engage or correspond with the respective channels 36 of the support 2. The profile units 4*c*–4*d* can also be either glued or screwed to the support 2 or even both, as discussed above.

Referring specifically to FIG. 4, the face panel 6 is shown with a glass or mirrored surface. The face panel 6 is supported by the profile units 4*c* and 4*d*. In particular, 4*c* has a groove 40 which is coextensive with the length of the profile unit 4*c*. The profile unit 4*d* has a groove 42 which is coextensive with its length. The top edge 30 of the face panel 6 engages groove 40 of the profile unit 4*c* and the bottom edge 32 of the face panel 6 engages the groove 42 of the profile unit 4*d*. This arrangement, will support the face panel 6, as discussed above. Note, the profile units 4*c* and 4*d* do not have an integral groove for slotwall hardware. Grooves 28, which are formed between the units 4*c* and 4*d* when they are aligned adjacent one another, are the only grooves for engaging slot wall hardware associated with these profiles 4*c* and 4*d*.

FIG. 5

The profile units 4*e* and 4*f* are another profile embodiment used in the present invention.

Figure 5:
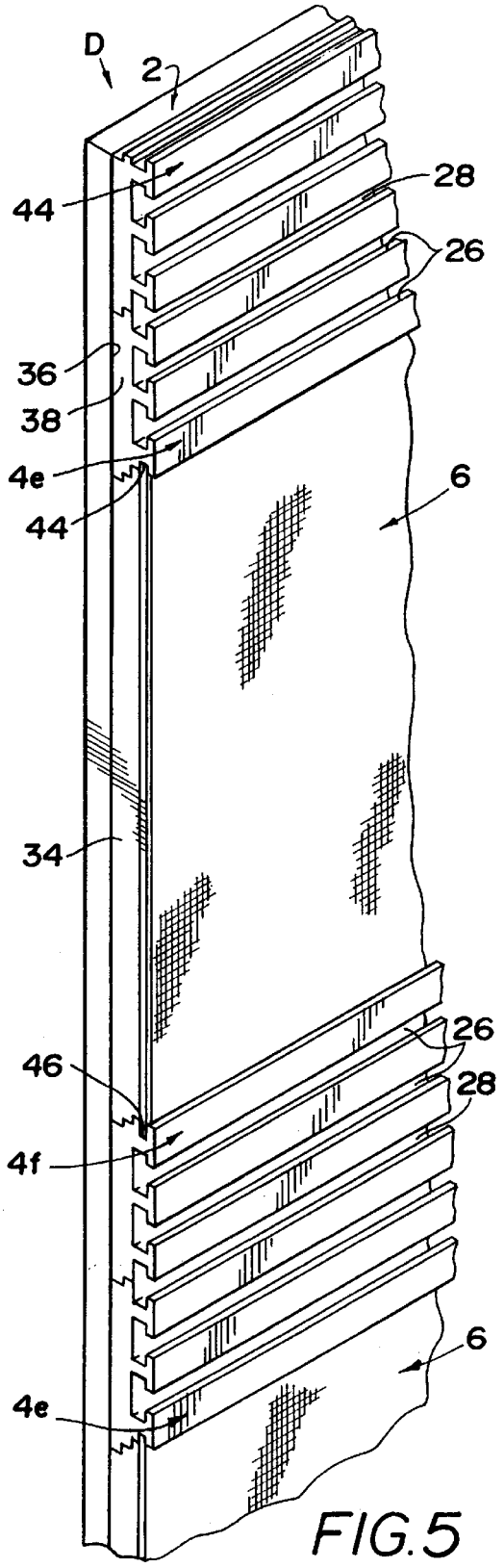
FIG. 5 is a fragmentary left front isometric view of another alternative embodiment of the display wall assembly made in accordance with the present invention.

Referring to FIG. 5, the face panel 6 is shown with a cloth or fabric material. The face panels 6 are supported by the profile units as discussed above, namely, the face panel 6, shown here, is supported by the groove 44 of the unit 4*e* and the groove 46 of the unit 4*f*. Note, profile units 4*e* and 4*f* each have two integral grooves 26 and a groove 28 is also formed between the units 4 when they are aligned adjacent one another, as shown.

Note, as discussed above, the face panels 6 can also be glued or laminated to the intermediate reinforcing structure 8, for further support.

With regard to any of the embodiments discussed above, it is understood that the display, wall assembly D can comprise numerous profile units and numerous panels. Additionally, there could be numerous arrangements, or groove patterns, of the profile units and the panels. Thus, a merchant can customize its own display wall assembly. In other words, if a merchant desires to have some grooves at one particular height for a certain length and then more grooves at a different height, this can be accomplished with the present invention while still maintaining the aesthetically pleasing appearance of the present display wall assembly.

FIG. 6

Figure 6:
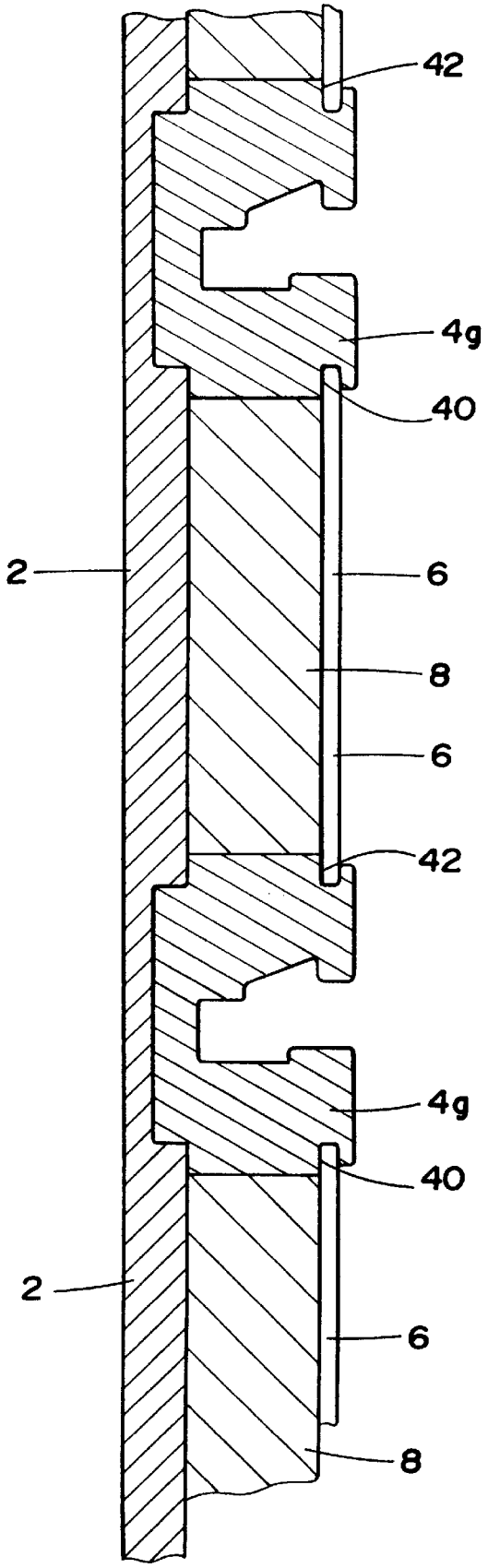
FIG. 6 is side cross-sectional view of another embodiment of the display wall assembly using profile unit between two adjacent panels.

A display wall assembly D using another embodiment of the deep dimension profile 4*g* is shown in FIG. 6. The profile 4*g* is advantageously extruded with the channels or slots 40 and 42 used to support the panel 6. The profile 4*g* is advantageously used where only a single profile unit is needed between two adjacent panels 6.

A person of ordinary skill in the art will understand that the display wall assembly of the present invention will be sturdy, rigged, light-weight appealing to the consumer eye and versatile because of the use of a light-weight intermediate reinforcing structure and a face panel.

While this invention has been described as having a preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A display wall assembly for displaying items, comprising:

a) a support;

b) a plurality of profile units, said plurality of profile units including a groove for operably supporting said items, said profile units being attached to said support in a spaced relationship;

c) a panel being supported by and disposed between said profile units; and, d) a light-weight intermediate reinforcing structure being interposed between said panel, said support and said profile units.

2. A display wall assembly as recited in claim 1, further including:

a) at least on side panel attached to said intermediate reinforcing structure for covering exposed portions of said intermediate reinforcing structure.

3. A display wall assembly as recited in claim 1, wherein:

a) said profile units having back surfaces; and, b) said support including a plurality of stiffeners attached to said back surfaces of said profile units.

4. A display wall assembly as recited in claim 1, wherein:

a) said support is generally planar in shape.

5. A display wall assembly as recited in claim 1, wherein:

a) said profile units are glued to said support.

6. A display wall assembly as recited in claim 1, wherein:

a) said profile units are screwed to said support.

7. A display wall assembly as recited in claim 1, wherein:

a) said support includes channels; and, b) said profile units include attachment portions, said portions being disposed within said channels.

8. A display wall assembly as recited in claim 1, wherein:

a) said profile units are arranged in a substantially parallel relationship.

9. A display wall assembly as recited in claim 1, wherein:

a) said profiles units are disposed in a substantially horizontal manner.

10. A display wall assembly as recited in claim 1, wherein:

a) said profile units are arranged on said support forming grooves therebetween.

11. A display wall assembly as recited in claim 1, wherein:

a) said panel is attached to said intermediate reinforcing structure.

12. A display wall assembly as recited in claim 1, wherein:

a) one of said profile units having a flange and another having a first channel; and, b) said panel includes a top edge being coextensive with said first channel of one of said profile units and a bottom edge being engaged and coextensive with said flange of one of said profile units.

13. A display wall assembly as recited in claim 1, wherein:

a) said panel is generally planar in shape.

14. A display wall assembly as recited in claim 1, wherein:

a) said intermediate reinforcing structure is attached to said support.

15. A display wall assembly as recited in claim 14, wherein:

a) said intermediate reinforcing structure is made of a honey comb type structure.

16. A display wall assembly for displaying items, comprising:

a) a back support;

b) a plurality of profile units each having an outer face surface and said plurality of profile units including a groove for operably supporting said items, said profile units being attached to said back support in a spaced relationship;

c) a panel being supported by and disposed between said profile unit such that said panel is substantially flush with said outer face surface of said profile units; and, d) a light-weight spacer being interposed between said panel, said back support and said profile units.

17. A display wall assembly as recited in claim 16, wherein:

a) said profile units include upper and lower slots; and b) said panel includes upper and lower edges received in respective slots.

18. A method of manufacturing a display wall assembly for displaying items, comprising:

a) providing a support;

b) supplying a plurality of profile units, said plurality of profile units including a groove for operably supporting said items;

c) arranging said profile units, in a spaced relationship;

d) attaching said profile units to said support;

e) supplying a panel;

f) positioning said panel between said profile units, for support of said panel;

g) providing a light-weight intermediate reinforcing structure; and, h) interposing said intermediate reinforcing structure between said panel, said support and said profile units, for aiding said panel from collapsing toward said support.

19. A method of manufacturing a display wall assembly for displaying items as recited in claim 18, further comprising the steps of:

a) providing upper and lower slots in said profile units; and, b) securing said panel in said slots.

20. A method of manufacturing a display wall assembly for displaying items as recited in claim 18, and further comprising the steps of:

a) providing recesses in said support; and b) securing said profiles in said recesses.

* * * * *